US008141721B2

(12) United States Patent
Harris-Bowman

(10) Patent No.: US 8,141,721 B2
(45) Date of Patent: Mar. 27, 2012

(54) JEWELRY ORGANIZATION, STORAGE, AND TRANSPORTATION ASSEMBLIES AND METHODS

(76) Inventor: Jonna Harris-Bowman, Spokane, WA (US)

( * ) Notice: Subject to any disclaimer, the term of this patent is extended or adjusted under 35 U.S.C. 154(b) by 193 days.

(21) Appl. No.: 12/496,361

(22) Filed: Jul. 1, 2009

(65) Prior Publication Data

US 2010/0000884 A1 Jan. 7, 2010

Related U.S. Application Data

(60) Provisional application No. 61/077,834, filed on Jul. 2, 2008.

(51) Int. Cl.
*A45C 11/04* (2006.01)

(52) U.S. Cl. ..... 211/85.2; 206/6.1; 211/96; 211/168

(58) Field of Classification Search ..... 206/6.1, 206/566; 211/85.2, 96, 99, 100, 113, 116, 211/168, 171, 169; 248/304, 317
See application file for complete search history.

(56) References Cited

U.S. PATENT DOCUMENTS

| | | | | |
|---|---|---|---|---|
| 2,131,990 | A * | 10/1938 | Tisdale | 211/96 |
| 4,776,650 | A * | 10/1988 | Ferenzi | 211/85.2 |
| 5,449,073 | A * | 9/1995 | DeBeverly | 211/85.2 |
| 5,762,184 | A * | 6/1998 | Greiner | 206/6.1 |
| 5,826,858 | A * | 10/1998 | Gordon | 254/17 |
| 5,931,319 | A * | 8/1999 | Murphy | 211/85.2 |
| 6,394,291 | B2 * | 5/2002 | Maier-Hunke | 211/169 |

* cited by examiner

*Primary Examiner* — Luan K Bui
(74) *Attorney, Agent, or Firm* — Wells St. John P.S.

(57) ABSTRACT

Jewelry support assemblies are provided that can include a substantially planar base portion having a member extending therefrom, the member including a plurality of openings; a plurality of arms extending from the openings, individuals ones of the arms being associated with individual ones of the openings; and a plurality of rods extending from the arms, the rods being staggered along the length of the arms. Other assemblies are also provided that include: a rod extending from a first end to a second end; flexible material at least partially wrapping the rod and extending therefrom, the material including multiple layers of overlapping material; and wherein exposed overlapping portions of material include openings. Jewelry storage assemblies are provided that can include: a case comprising at least two components configured to be coupled when in a closed position; and one of the two components configured to house a jewelry support assembly.

9 Claims, 13 Drawing Sheets

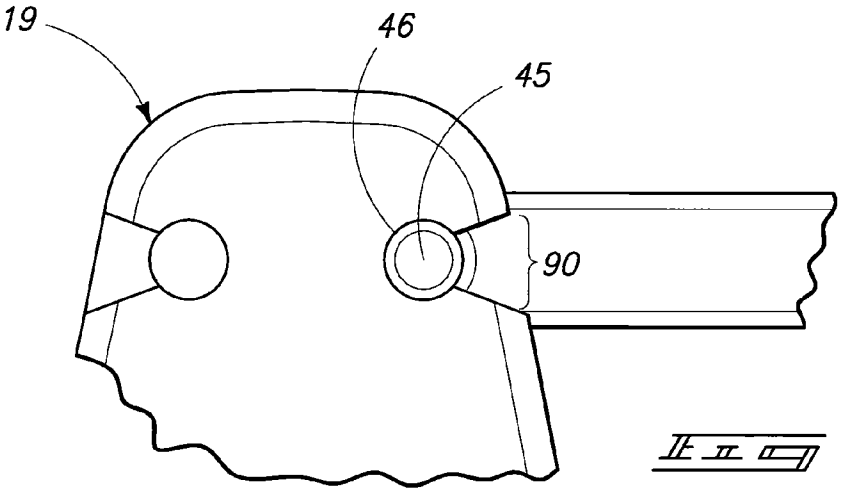
FIG 9A
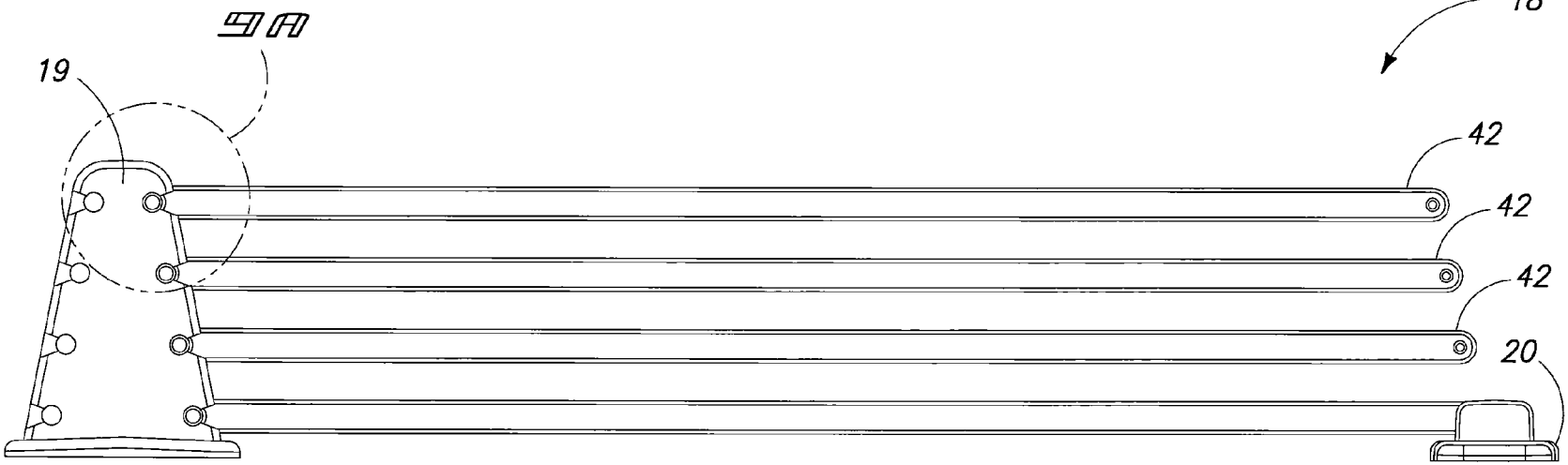
FIG 9
FIG 9A 132a
138a
138a
138a
134a
130a
136a 134
138
138
138
132
130
136

130a
132a
138a
138a
134a
136a 134
136
138
138
132
130

JEWELRY ORGANIZATION, STORAGE, AND TRANSPORTATION ASSEMBLIES AND METHODS

RELATED PATENT APPLICATION

This application claims priority to U.S. Provisional Patent Application Ser. No. 61/077,834, which was filed on Jul. 2, 2008, the entirety of which is incorporated by reference herein.

TECHNICAL FIELD

The present disclosure relates to the field of jewelry organization, storage, and transportation.

BACKGROUND

People continually wage a constant battle organizing the numerous pieces of apparel accessories such as jewelry in their possession. Centuries upon centuries of innovations have attempted to provide the answer to this battle, and while some have been successful, others have been difficult or impractical to utilize. Jewelry cases, jewelry boxes, jewelry racks, even jewelry hangers have been provided, yet none to date have been able to solve the problems associated with the organization, transportation and storage of apparel accessories such as jewelry in the form of necklaces, earrings, and rings. The present disclosure provides jewelry storage organization and transportation assemblies and methods.

SUMMARY OF THE DISCLOSURE

Jewelry support assemblies are provided. The assemblies can include a substantially planar base portion having a member extending therefrom, the member including a plurality of openings; a plurality of arms extending from the openings, individuals ones of the arms being associated with individual ones of the openings; and a plurality of rods extending from the arms, the rods being staggered along the length of the arms.

Other jewelry support assemblies are also provided, the assemblies can include: a rod extending from a first end to a second end; flexible material at least partially wrapping the rod and extending therefrom, the material including multiple layers of overlapping material; and wherein exposed overlapping portions of material include openings.

Jewelry storage assemblies are provided that can include: a case comprising at least two components configured to be coupled when in a closed position; and one of the two components configured to house a jewelry support assembly.

BRIEF DESCRIPTION OF THE DRAWINGS

Embodiments of the disclosure are described below with reference to the following accompanying drawings.

FIGS. 1 and 1A are jewelry storage assemblies according to example embodiments.

FIG. 3 depicts a method of storing and transporting jewelry according to an embodiment.

FIG. 4 depicts an assembly for storing and displaying jewelry according to an embodiment.

FIGS. 9 and 9A are another view of the assembly of FIG. 4 according to an embodiment with FIG. 9A being a detailed view of a portion of FIG. 9.

FIG. 12 is a jewelry storage and display assembly according to an embodiment.

FIGS. 13 and 13A are jewelry storage organization and display assembly according to an embodiment.

DESCRIPTION

This disclosure is submitted in furtherance of the constitutional purposes of the U.S. Patent Laws "to promote the progress of science and useful arts" (Article 1, Section 8).

Figure 1:
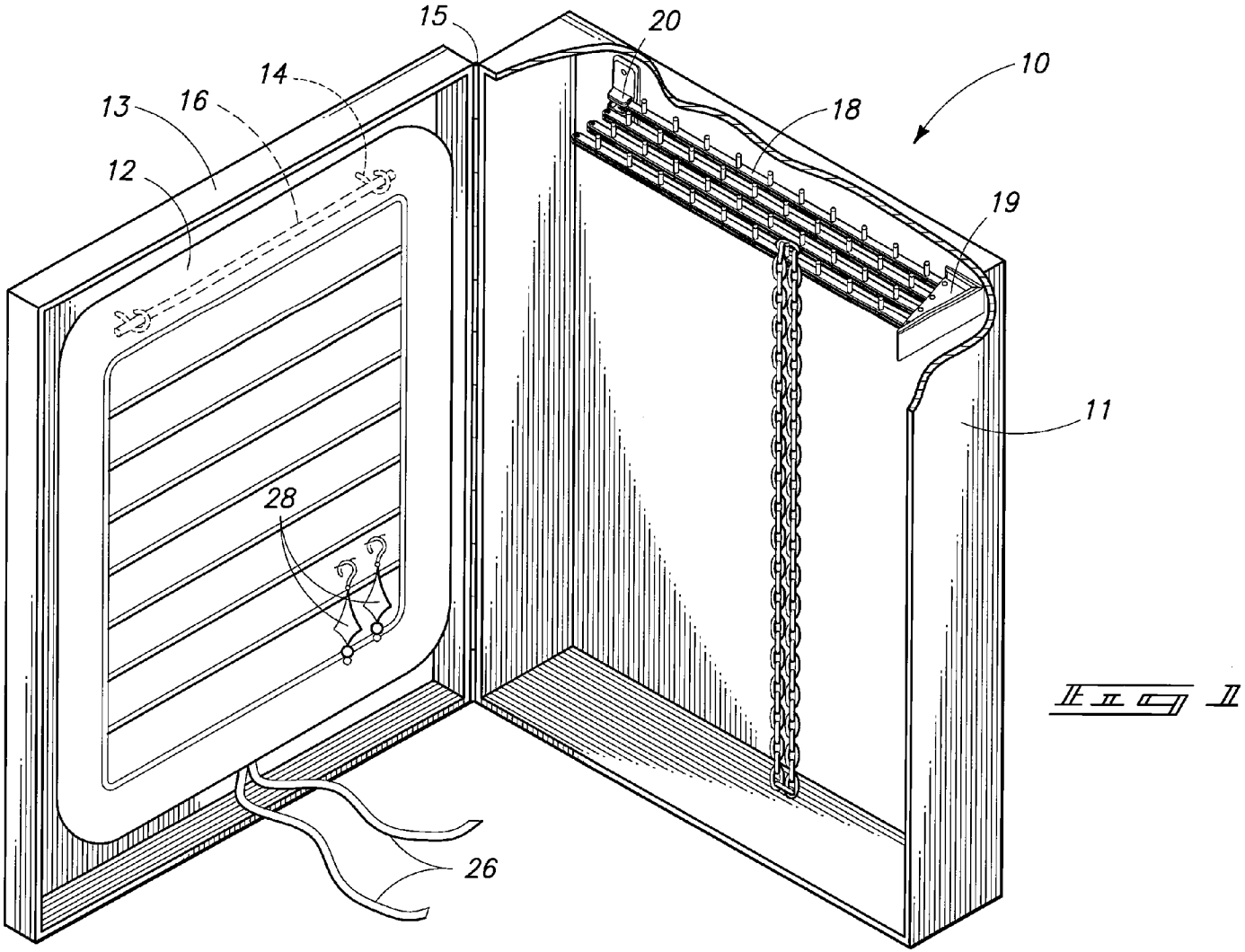
Figure 11A:
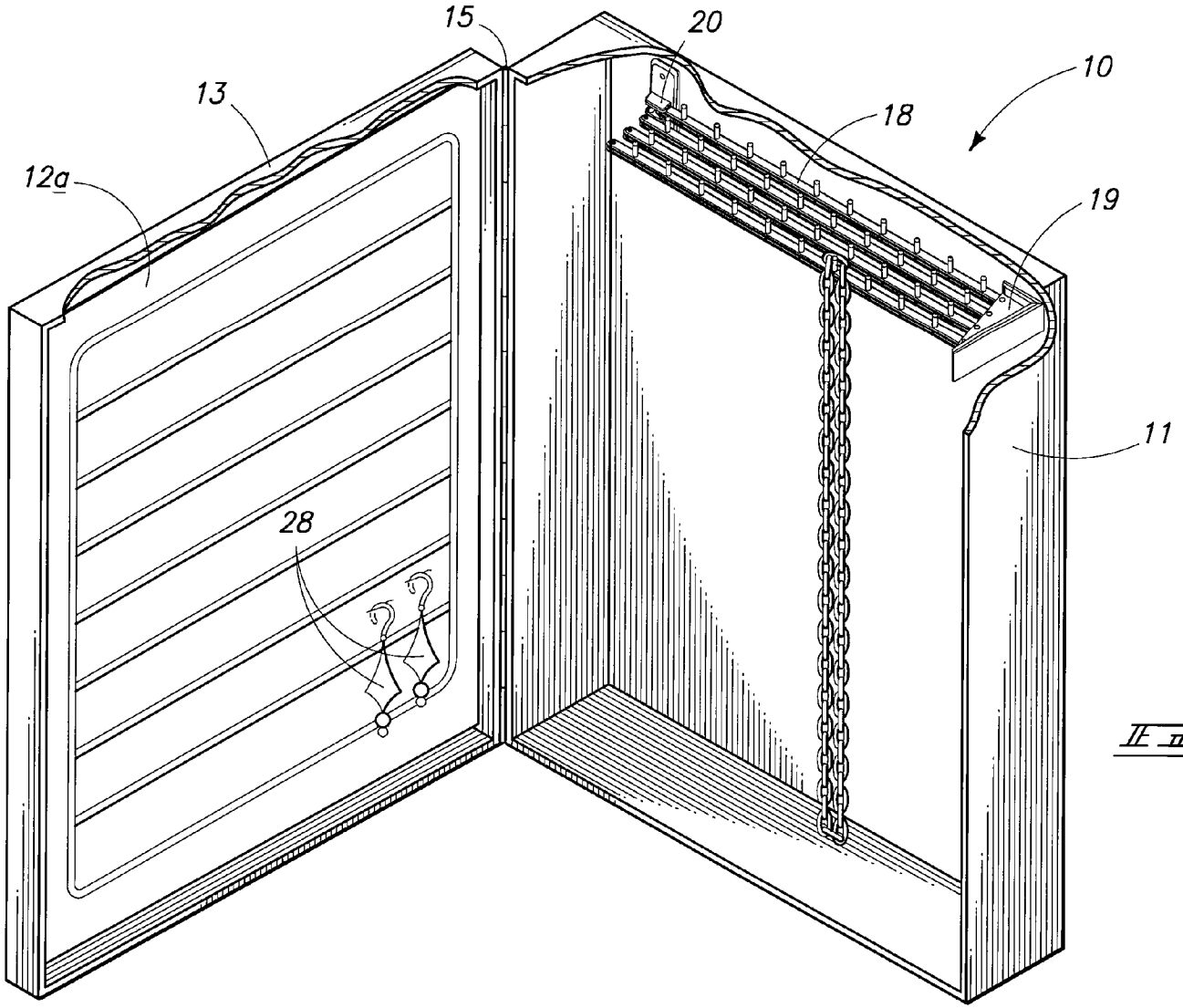
FIG. 11 is the assembly of FIG. 4 according to an embodiment.

The assembly and methods of the present disclosure are described with reference to FIGS. 1-13A. Referring first to FIG. 1, a storage assembly 10 is shown that depicts a typical closeable box configuration. Assembly 10 can be configured as a case to include at least two components 11 and 13 that may be configured to be coupled when in a closed position. Components 11 and 13 may be coupled via a hinge 15, for example. Either or both of components 11 and 13 may be configured to receive jewelry support, display, storage, and/or transportation assemblies. Components 11 and/or 13 may be portions of another assembly for example. Assemblies that these components can be part of include jewelry cases, chest of drawers, the components can be a door to the jewelry case or chest of drawers, and the components may or may not have a mirrored face.

Assembly 10 includes a jewelry display storage and transportation assembly 12 that can be removably fixedly coupled to assembly 10 via hooks 14 and rod 16, for example. While displayed as hooks and rods in accordance with the figure, many other removable/fixed attachment methods and devices are contemplated. Assembly 10 can also include organization, storage and display assembly 18 which can be fixedly mounted to assembly 10, for example, utilizing mounting portions 19 and 20. According to example implementations, assembly 12 can include flexible material at least partially wrapping rod 16 and extending therefrom.

Referring to FIG. 1A, another embodiment of storage assembly 10 is shown with jewelry display and storage assembly 12*a*. In accordance with this embodiment, assembly 12*a* is secured to assembly 10. Assembly 12*a* can include a backing having a perforated material thereover. The backing can be configured to be affixed to a portion of assembly 10, for example, the interior of a door of assembly 10 as shown. The backing can be rigid or be constructed of a heavier material than the perforated material, such as canvas for example.

Figure 2:
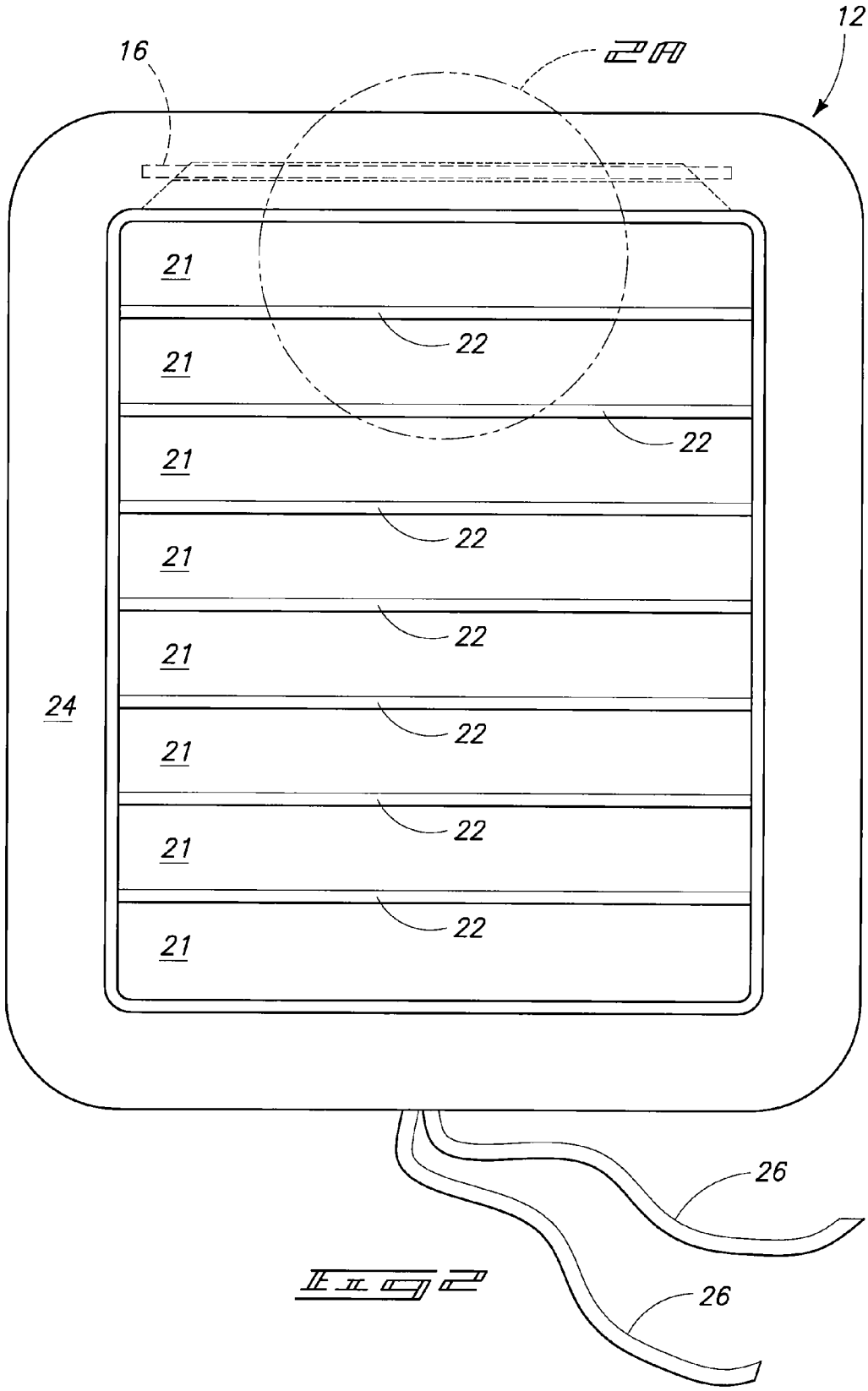
FIG. 2 is a jewelry storage and transportation assembly according to an embodiment.

Assembly 12 is shown in greater detail in FIG. 2 to depict multiple panels 21 that overlap one another at borders 22. These panels can be configured as multiple layers of overlapping flexible material. The exposed portions of the material can be configured as a decorative doilie or lace-type material. This overlapping can be considered straight, pleated, and/or gathered according to certain specific implementations, and panels 21 can be constructed of a material that can be or is already perforated to provide for the collection or mounting of jewelry items such as earrings. The exposed panels can be approximately the length of a dangling earring 28, for example (see, e.g., FIG. 2A).

Assembly 12 can also include a border portion 24 surrounding panels 21, and this border portion can be decorative in nature and effect. As also shown at the top portion of assembly 12, a rod or hanging assembly 16 can be provided to allow for the coupling of assembly 12 to stationary portions of storage assemblies, such as storage assembly 10 of FIG. 1. Assembly 12 can also include binding assembly 26 in the form of strings or ties that can be utilized to maintain assembly 12 in its transportation position which will be discussed later.

Figure 2A:
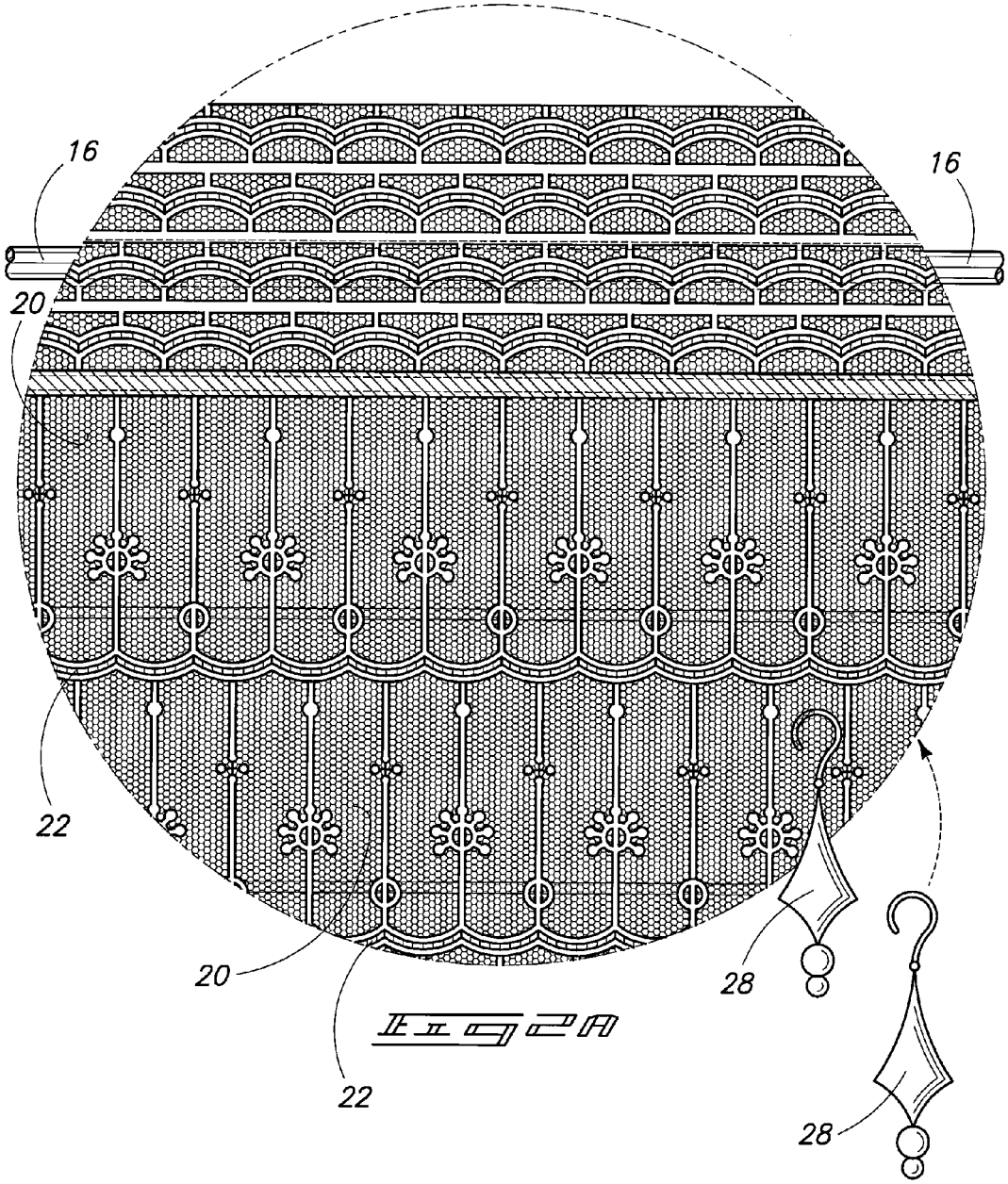
FIG. 2A is a detail of a portion of the embodiment of FIG. 2.

Referring to FIG. 2A, a more detailed view of panels 21 are shown with border 22. As shown in FIG. 2A, panels 21 overlap other panels 21 to form a straight, pleated, and/or gathered pattern of assembly 12. According to an example implementation, the material of panels 21 can be a lace edging. As also shown on FIG. 2A, jewelry or apparel accessory or jewelry 28 such as an earring can be hung on panels 21 in the upright or display position as shown in FIG. 1. Hanging within a jewelry box or along a stationary assembly, jewelry can be displayed for the user to pick and choose from the jewelry they would like to select for that particular occasion.

Referring to FIG. 3, assembly 12 can be removed from its stationary display position, laid horizontally for example, and rolled up to form a bundle 32. Bundle 32 can be maintained in this bundle position for transportation utilizing restraint assembly 26. Restraint assembly 26 can be simply ties and/or other embodiments contemplated can include Velcro® tabs along the specific edges of assembly 12.

Referring to FIG. 4, an embodiment of storage and display assembly 18 of FIG. 1 is shown in greater detail. Storage and display assembly 18 can include mounting brackets 19 and 20 to fixedly attach assembly 18 to a stationary and/or case structure. Bracket or base portion 19 can be substantially planar and have a member 43 extending therefrom. Member 43 can include a first end associated with base portion 19. Member 43 can extend from the first end to a second end. As an example, first end of member 43 can have a width larger than a width of the second end. According to an example implementation, the member 43 can taper along its width from the first end to the second end. Member 43 can define an edge 23 extending from the first end to the second end. Member 43 can include a plurality of openings 46 and these openings may be located along edge 23 and in some implementations these openings may be aligned along edge 23. Openings 46 may be offset from edge 23 and evenly spaced along a line between the first and second ends of the member.

Assembly 18 can include a plurality of extending arms 42 and a back or continuous arm 44 between the brackets. Arms 42 as well as arm 44 can be pivotally attached to either or both of mounting brackets 19 or 20. As an example, the pivotal attachment configuration can include a shaft 45 within opening 46. Individual ones of the arms can be associated with individual ones of the openings. One or more of arms 42 and/or 44 can include a first end extending to a second end. The first end can be configured to rotatably couple with one or more of the openings 46. The first end of arms 42 and/or 44 can include a shaft 45 that may extend normal to the arm it is associated with. Shaft 45 may be configured to be received within and opening 46. Shaft 45 can include an end distal to the arm and this distal end can define a rib configured to seat the shaft within the opening.

Figure 5:
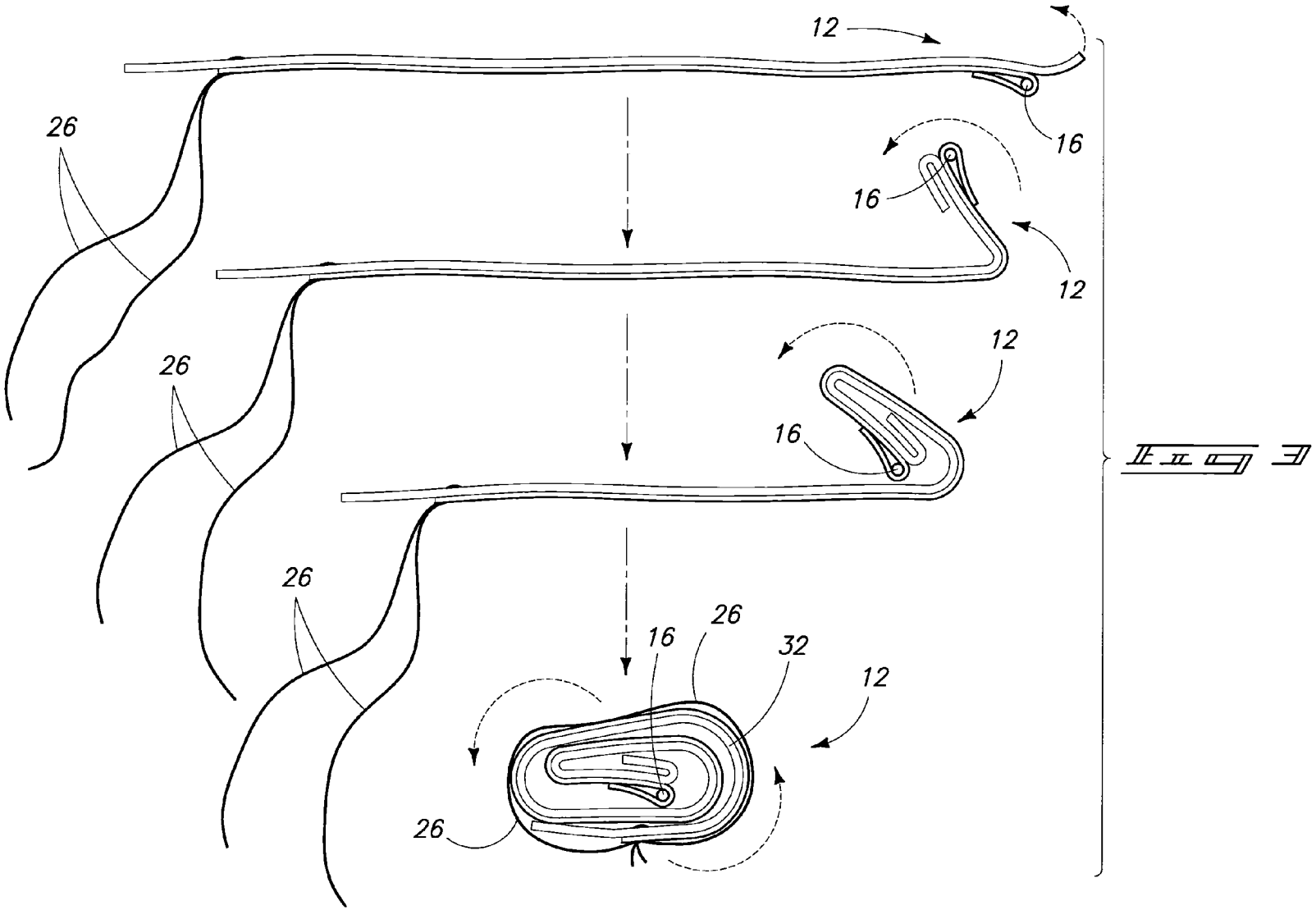
FIG. 5 is another view of the assembly of FIG. 4 according to an embodiment.
Figure 6:
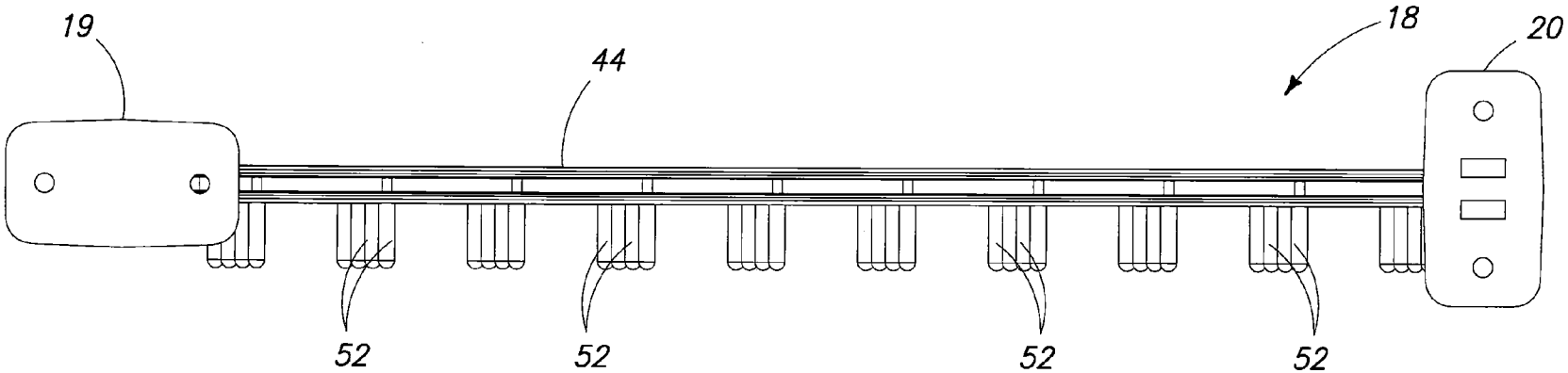
FIG. 6 is another view of the assembly of FIG. 4 according to an embodiment.

Referring to FIG. 5, a front view of assembly 18 is shown demonstrating rods 52 from arms 42. As displayed in FIG. 5, arms 42 can extend various lengths from bracket 19. As shown in FIGS. 5 and 6, a plurality of rods 52 can be provided extending across individual arms 42. Rods 52 can be staggered along the length of arms 42. Rods 52 can extend normal to arms 42. Rods 52 can be also be evenly spaced along a length of arms 42. Rods 52 can be used to mount or hang necklaces, for example, for display and organization. One or more of rods 52 can also define a recess along their length. The recess can be configured to more securely mount jewelry. The arms, brackets, shafts, and/or rods, can be constructed of hardened polymers such as plastics, as well as wood and/or metal in a desired combination.

Figure 7:
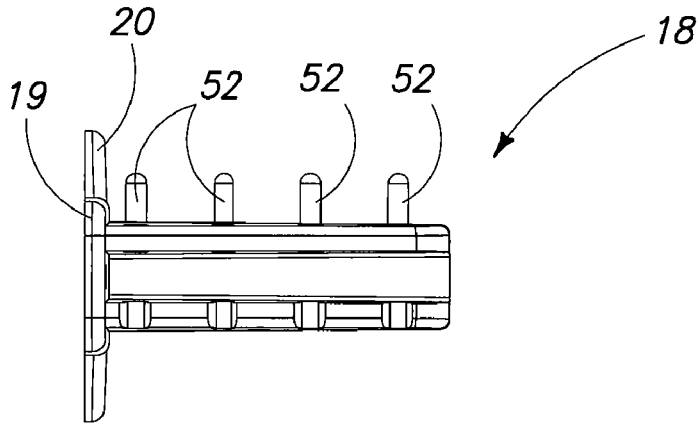
FIG. 7 is the assembly of FIG. 4 according to an embodiment.
Figure 8B:
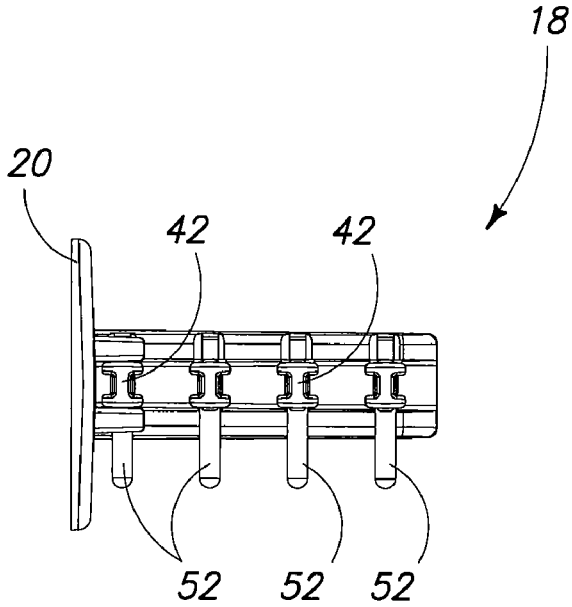
FIG. 8 is another view of the assembly of FIG. 4 according to an embodiment.

Referring to FIG. 6, a posterior view of assembly 18 is shown displaying mounting portions of brackets 19 and 20, for example. Referring to FIGS. 7 and 8, side views of assembly 18 are provided demonstrating, for example, rods 52 as well as arms 42 in conjunction with rods 52.

Referring to FIG. 9, the mounting method of arms 42 within bracket 19, for example, is depicted. As depicted, arm 42 can include a mounting structure having a rod 45 therein configured to fit within opening 46 within bracket 19. Rod portion 45 can extend from both the upper and lower edges of arm 42 and bracket 19 can include a closed opening at the upper portion of bracket 19 and another opening having a passageway thereto. According to example implementations, this can allow the user to pivot an upper portion of rod 45 to within an opening of bracket 19 and then slidably engage a lower rod 45 of arm 42 within opening 90 and collapsibly engage rod 45 within opening 46, thus allowing the user to remove individual arms from bracket 19. According to example implementations, rod 42 can also pivot within opening 46 of bracket 19.

Figure 10:
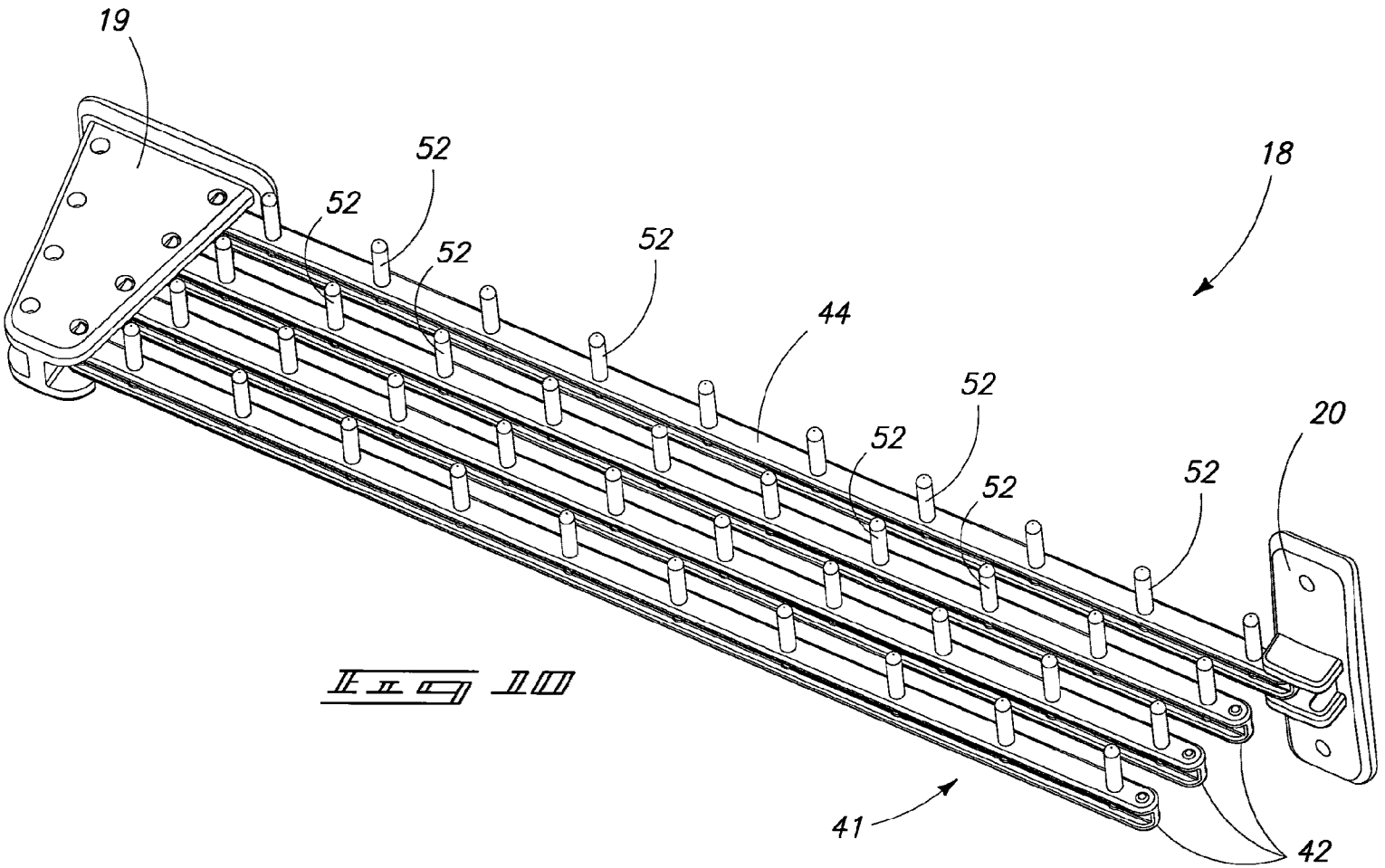
FIG. 10 is another view of the assembly of FIG. 4 according to an embodiment.
Figure 11:
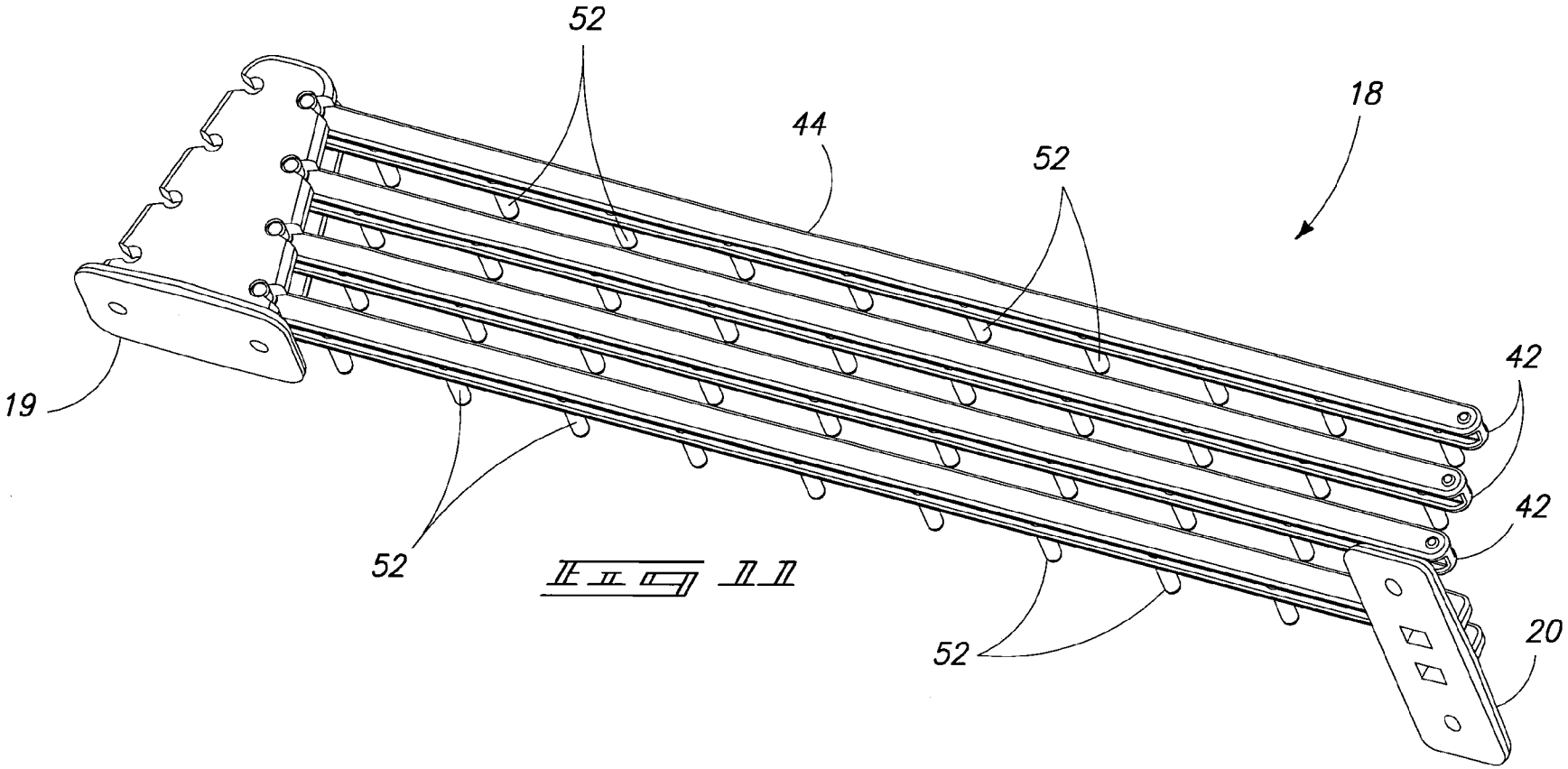
Figure 11:
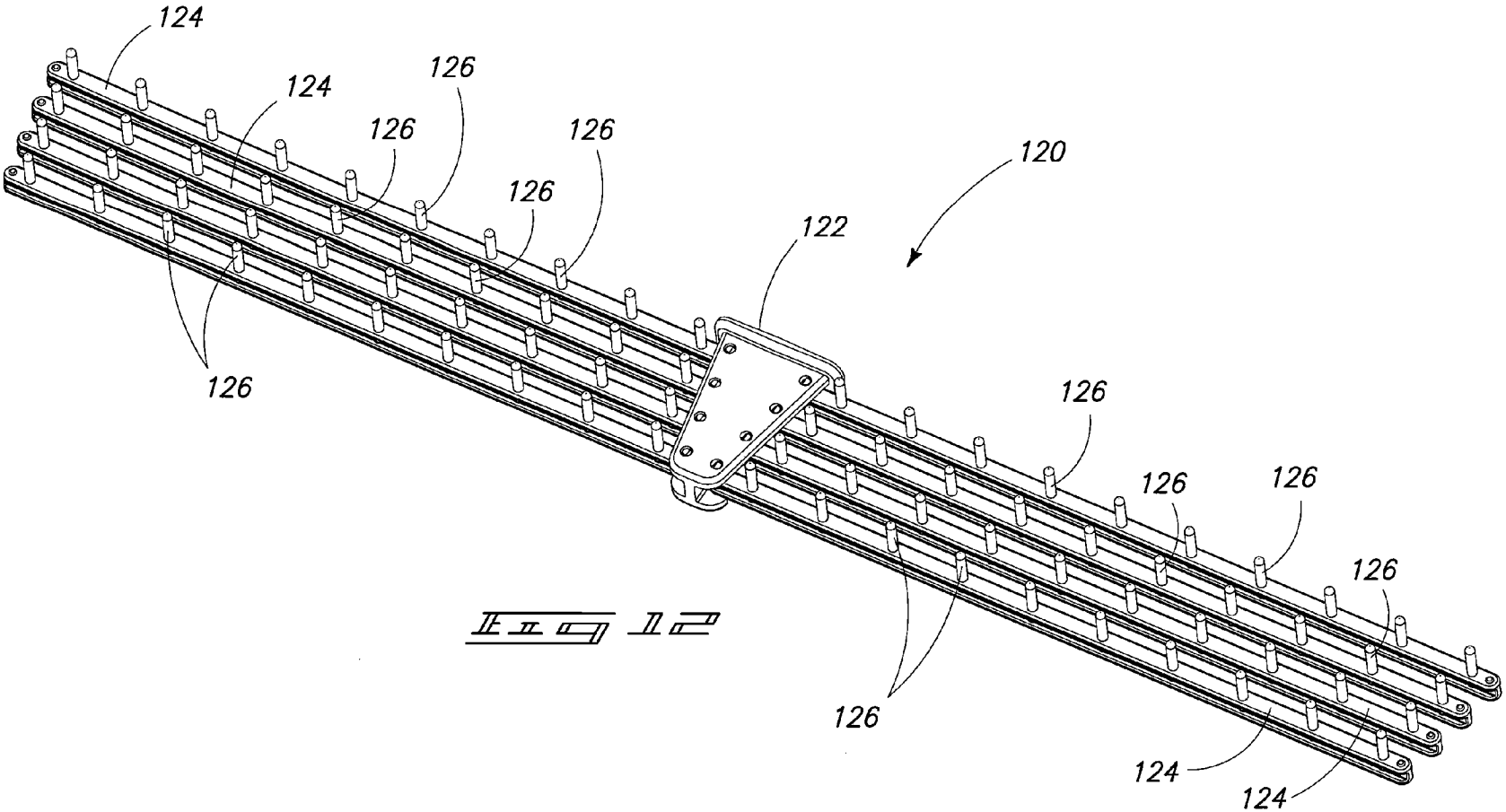
Figures 11, 11A:
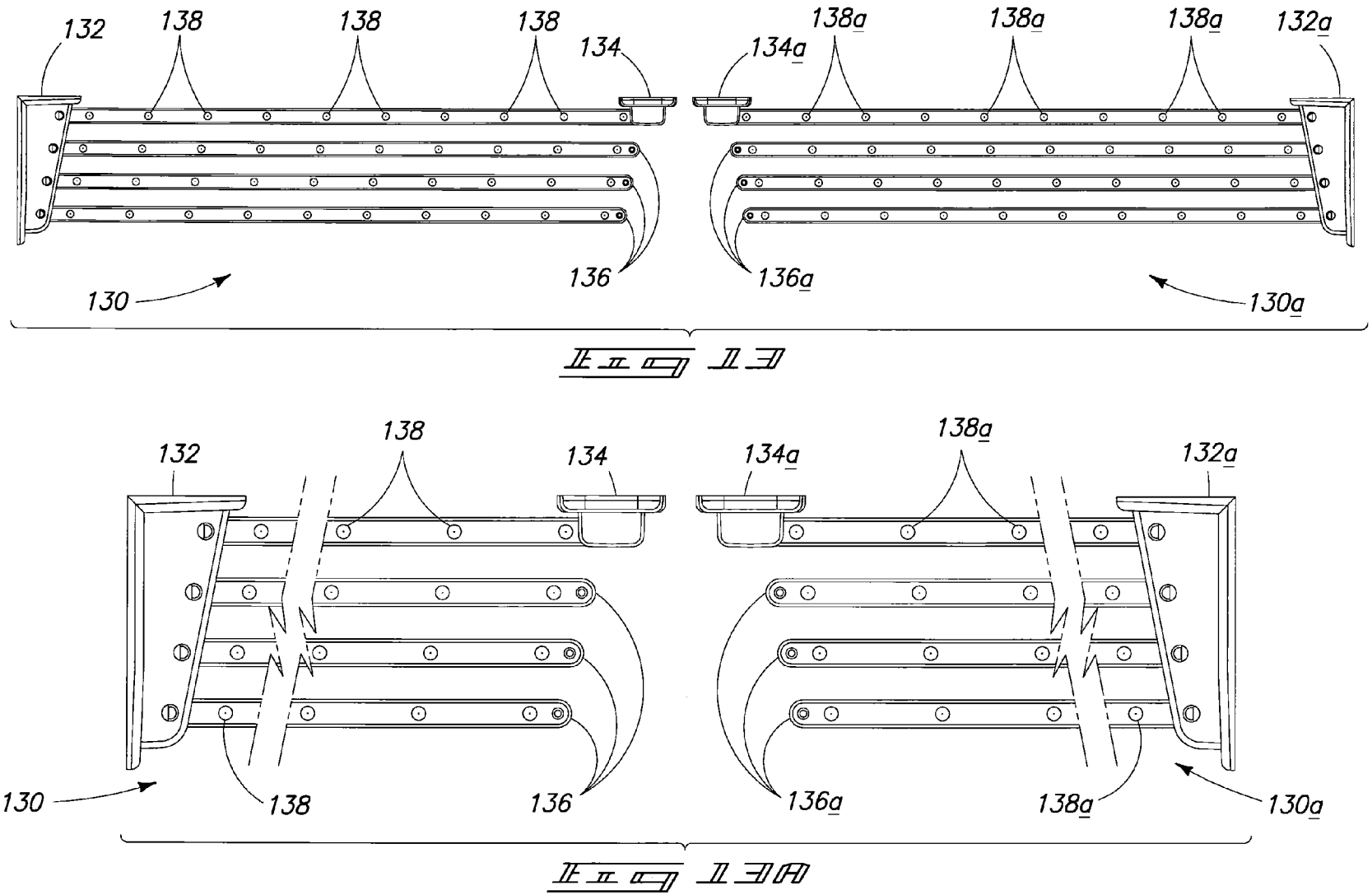

Referring to FIG. 10, another view of assembly 18 is provided that includes brackets 19 and 20 showing arms 42 and items 52 extending therefrom with arms 42 pivotally engaged within bracket 19. In accordance with example implementations, arms 42 include recess 41 extending along the length of arm 42.

Figure 11:
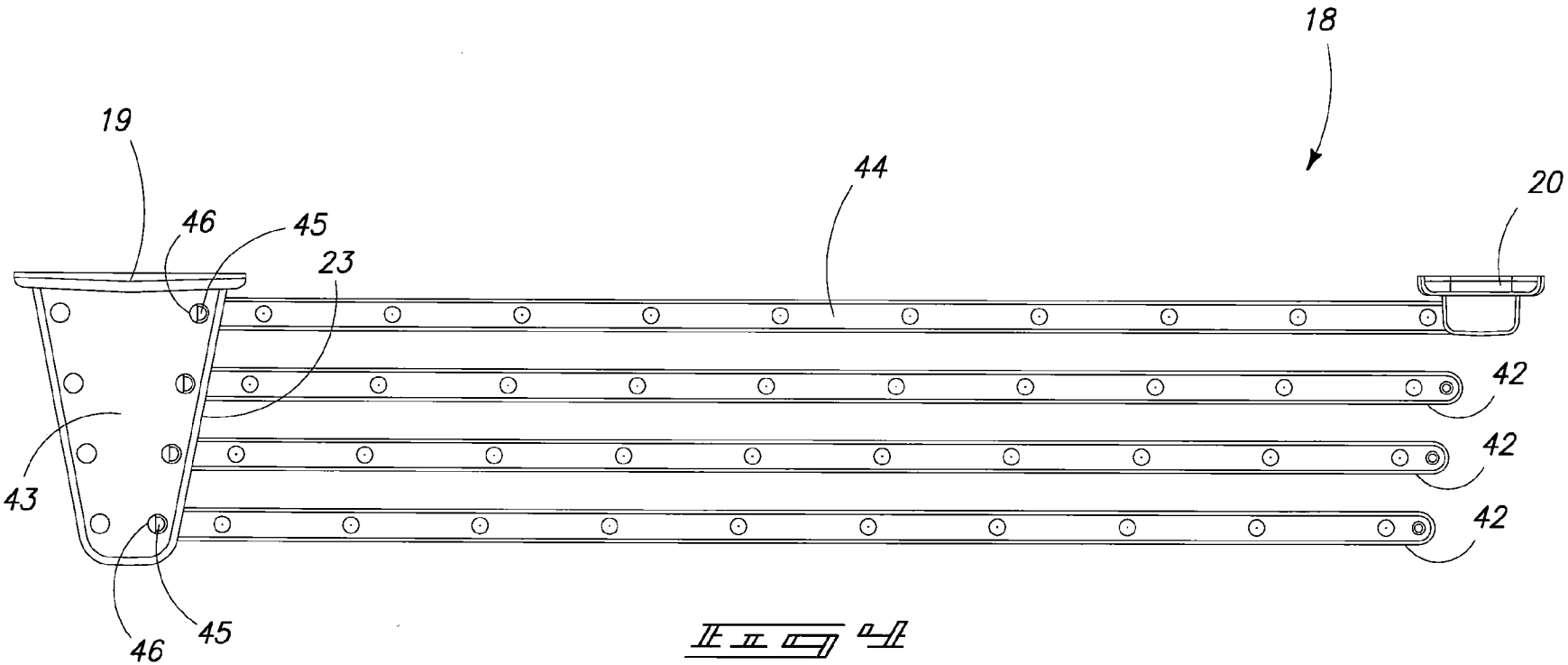
Figure 5:
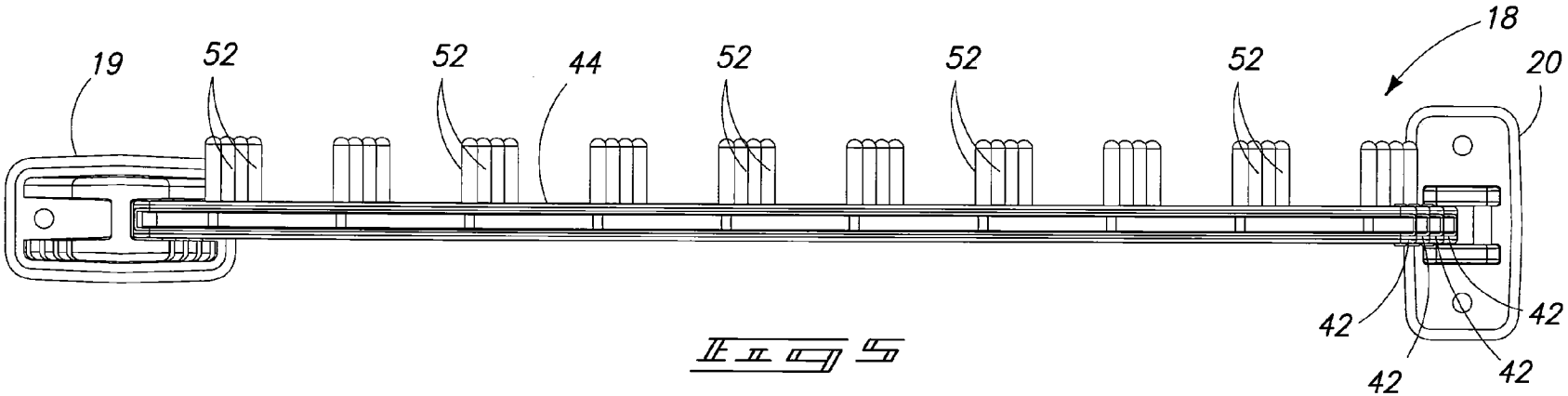

Referring to FIG. 11, another isometric view of assembly 18 is provided that displays assembly 18 from the lower portion.

Referring to FIG. 12, an alternative embodiment of the jewelry organization and assembly is displayed in the form of assembly 120. As shown, assembly 120 can have a central bracket 122 having a plurality of arms 124 extending therefrom. Individual ones of arms 124 can include extensions 126 configured to receive and removably couple with jewelry items such as necklaces, for example. Bracket 122 can be fixedly mounted to a stable structure, or even a removable structure such as the interior of a jewelry box.

Referring to FIG. 13 in yet another embodiment, assembly 130 is provided that has bracket 132 and 134 connected between arms 136 extending from bracket 132. According to this example embodiment, bracket 132 can be configured to fit within a corner of a structure to allow for the mounting of assembly 130 within boxes, for example. Bracket 132 can include a plurality of openings extending along one edge configured to receive rods from arms 136 as previously described.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

The invention claimed is:

1. A jewelry support assembly, the assembly comprising:

first and second substantially planar bases, each having an upper and lower pair of members extending therefrom, the upper and lower members extending from the first base including a plurality of openings, with the individual openings in the lower members including individual passageways extending from an edge of the member to individual openings, the upper and lower members extending from the second base including at least one opening;

a plurality of arms pivotally engaging and extending from the openings of the upper and lower members of the first base, individuals ones of the arms being associated with individual ones of the openings, wherein at least one of the arms engage an opening of the members of the first base and extends to engage the opening of the members of the second base, one or more of the arms defining a recess along their length; and a plurality of rods extending from the arms, the rods being staggered along the length of the arms.

2. The jewelry support assembly of claim 1 wherein the members of the first base comprises a first end extending to a second end, the first end associated with the first base and having a first width, the second end having a second width less than the first width.

3. The jewelry support assembly of claim 2 wherein the members of the first base taper in width along its length from the first end to the second end.

4. The jewelry support assembly of claim 1 wherein the edge of the members of the first base extends from a first end proximate the first base and terminating to a second end, the plurality of openings located proximate the edge.

5. The jewelry support assembly of claim 4 wherein the openings are aligned along the edge.

6. The jewelry support assembly of claim 5 wherein the openings are offset from the edge and evenly spaced along a line between the first and second ends of the edge of the members of the first base.

7. The jewelry support assembly of claim 1 wherein one or more of the arms comprise a first end extending to a second end, the first end defining a pair of shafts extending normally from opposing edges of the arm and configured to rotatably couple with one or more of the openings.

8. The jewelry support assembly of claim 7 wherein the one of the pair of shafts engages openings of the top member of the base and the other opposing shaft engaging the openings of the bottom member of the base.

9. The jewelry support assembly of claim 8 wherein the other opposing shaft includes an end distal to the arm, the end defining a rib configured to seat the shaft within the opening of the bottom member of the base.

* * * * *